US010258854B2

(12) United States Patent
Chen

(10) Patent No.: US 10,258,854 B2
(45) Date of Patent: Apr. 16, 2019

(54) ARCH BASKETBALL TRAMPOLINE SUPPORT

(71) Applicant: Samuel Chen, Shanghai (CN)

(72) Inventor: Samuel Chen, Shanghai (CN)

( * ) Notice: Subject to any disclaimer, the term of this patent is extended or adjusted under 35 U.S.C. 154(b) by 0 days.

(21) Appl. No.: 15/403,879

(22) Filed: Jan. 11, 2017

(65) Prior Publication Data

US 2017/0203174 A1 Jul. 20, 2017

Related U.S. Application Data

(60) Provisional application No. 62/279,455, filed on Jan. 15, 2016.

(51) Int. Cl.

| | |
|---|---|
| ***A63B 5/11*** | (2006.01) |
| ***A63B 63/08*** | (2006.01) |
| ***A63B 67/00*** | (2006.01) |
| ***A63B 71/02*** | (2006.01) |

(52) U.S. Cl.

CPC ..... *A63B 63/083* (2013.01); *A63B 5/11* (2013.01); *A63B 71/022* (2013.01); *A63B 2063/086* (2013.01); *A63B 2067/005* (2013.01); *A63B 2209/00* (2013.01); *A63B 2209/02* (2013.01); *A63B 2209/10* (2013.01)

(58) Field of Classification Search

CPC ..... A63B 63/083; A63B 69/0071; A63B 2243/0037; A63B 5/11

See application file for complete search history.

(56) References Cited

U.S. PATENT DOCUMENTS

| | | | | | |
|---|---|---|---|---|---|
| 1,388,697 | A | * | 8/1921 | Brecht | A47G 1/06 40/795 |
| 3,201,126 | A | * | 8/1965 | Nissen | A63B 5/11 182/139 |
| 3,339,925 | A | * | 9/1967 | Nissen | A63B 5/11 182/137 |
| 4,569,515 | A | * | 2/1986 | Gordon | A63B 5/11 273/401 |
| 4,598,905 | A | * | 7/1986 | Vrana | A63B 5/11 482/27 |
| 4,828,270 | A | * | 5/1989 | Chiang | A63B 63/00 273/401 |
| D391,303 | S | * | 2/1998 | Hadland | D21/306 |
| 5,833,557 | A | * | 11/1998 | Cole | A63B 5/11 473/472 |

(Continued)

*Primary Examiner* — Melba Bumgarner
*Assistant Examiner* — Amir A Klayman
(74) *Attorney, Agent, or Firm* — Clement Cheng

(57) ABSTRACT

A basketball trampoline device includes a trampoline having a trampoline bed, an enclosure, and enclosure poles supporting the enclosure. The basketball traveling has an upper arch member attached to a first enclosure pole. A lower arch member is attached to a second enclosure pole. The upper arch member and the lower arch member form an arch member pair. A basketball backboard and hoop are mounted to the upper arch member and the lower arch member by at least three backboard connectors. An upper backboard connector connects to the upper arch member and a lower backboard connector connects to the lower arch member. The upper arch member is fitted above the lower arch member to form the arch member pair defining a crescent-shaped flexible extension frame.

17 Claims, 4 Drawing Sheets

(56) References Cited

U.S. PATENT DOCUMENTS

| | | | | | |
|---|---|---|---|---|---|
| 6,135,922 | A * | 10/2000 | Nissen | A63B 5/11 | 482/27 |
| 6,918,846 | B2 * | 7/2005 | Chen | A63B 63/083 | 473/479 |
| 6,988,967 | B2 * | 1/2006 | Allison | A63B 5/11 | 473/469 |
| 7,481,740 | B2 * | 1/2009 | Colling | A63B 5/11 | 482/27 |
| 8,197,390 | B2 * | 6/2012 | Ikegami | A63B 5/11 | 482/29 |
| 8,585,558 | B2 * | 11/2013 | Chen | A63B 5/11 | 482/27 |
| 9,084,908 | B1 * | 7/2015 | Chen | A63B 5/11 | |
| 9,452,334 | B2 * | 9/2016 | Ko | A63B 63/083 | |
| 2006/0058123 | A1 * | 3/2006 | Publicover | A63B 63/083 | 473/485 |
| 2006/0232013 | A1 * | 10/2006 | Quinn | A63B 24/0021 | 273/400 |
| 2008/0269020 | A1 * | 10/2008 | Alexander | A63B 5/11 | 482/29 |
| 2010/0285926 | A1 * | 11/2010 | Ikegami | A63B 5/11 | 482/27 |
| 2014/0248997 | A1 * | 9/2014 | Miller | A63B 5/11 | 482/29 |
| 2014/0274570 | A1 * | 9/2014 | Chen | A63B 5/11 | 482/27 |
| 2015/0051049 | A1 * | 2/2015 | Andon | A63B 5/11 | 482/29 |

* cited by examiner

ARCH BASKETBALL TRAMPOLINE SUPPORT

This application is a non-provisional and claims domestic priority from U.S. provisional application 62/279,455 entitled Arch Basketball Trampoline Support by same inventor Samuel Chen, filed Jan. 15, 2016, the disclosure of which is incorporated herein by reference.

FIELD OF THE INVENTION

The field of the invention is in basketball trampoline devices.

DISCUSSION OF RELATED ART

A variety of different basketball backboards have been mounted to trampolines and are discussed in the prior art, but safety needs improvement with new designs.

SUMMARY OF THE INVENTION

A basketball trampoline device includes a trampoline having a trampoline bed, an enclosure, and enclosure poles supporting the enclosure. The basketball traveling has an upper arch member attached to a first enclosure pole. A lower arch member is attached to a second enclosure pole. The upper arch member and the lower arch member form an arch member pair. A basketball backboard and hoop are mounted to the upper arch member and the lower arch member by at least three backboard connectors. An upper backboard connector connects to the upper arch member and a lower backboard connector connects to the lower arch member. The upper arch member is fitted above the lower arch member to form the arch member pair defining a crescent-shaped flexible extension frame. The basketball trampoline device may have an arch member pair that forms a pair of parabolic shaped sections that converge at their lower ends where both the upper arch member and the lower arch member are clamped together at their lower ends.

The basketball trampoline device has fabric sleeves formed on the backboard for retaining the backboard to the arch members. The fabric sleeves form an upper backboard connector which receives the upper arch member, and the lower backboard connector receives the lower arch member. The arch member pair form a pair of parabolic sections that converge at their legs where both the upper arch member and the lower arch member are clamped together at their lower ends.

The arch members are preferably substantially flexible during play so that the backboard moves if struck by a user. The upper arch member and the lower arch member have lower ends that fit into arch mounts including an upper arch mount and a lower arch mount, the upper arch member has a smaller radius of curvature than the lower arch member.

The upper arch member and the lower arch member are made of the same material, namely flexible metal rods or flexible fiberglass rods. A first mount member connects the arch member pair to the first enclosure pole. The first mount member retains the lower arch member in an inside channel formed on the first mount member, and the first mount member retains the upper arch member in an outside channel formed on the first mount member. The first mount member further includes an enclosure pole channel that receives the first enclosure pole.

The first mount member is formed as an outside mount member that connects to an inside mount member. The inside mount member has an inside mount member flange and the outside mount member has an outside mount member flange. The inside mount member flange connects to the outside mount member flange.

BRIEF DISCUSSION OF THE DRAWINGS

Figure 1:
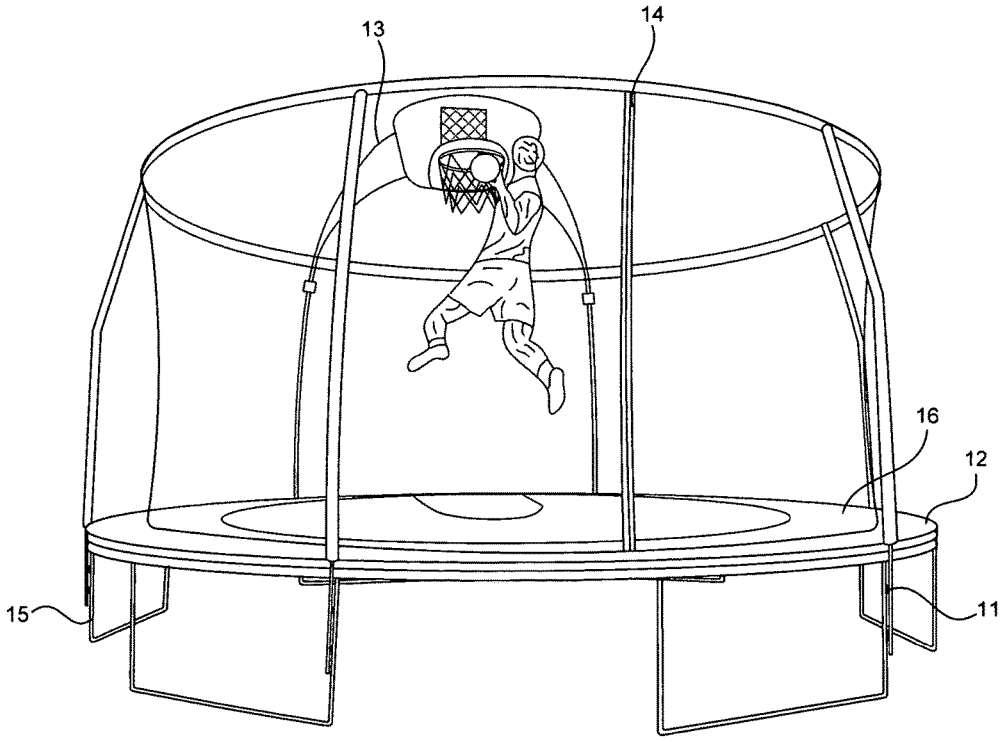
FIG. 1 is a perspective view of the present invention from the perspective of a viewer and on the ground next to the trampoline.
Figure 2:
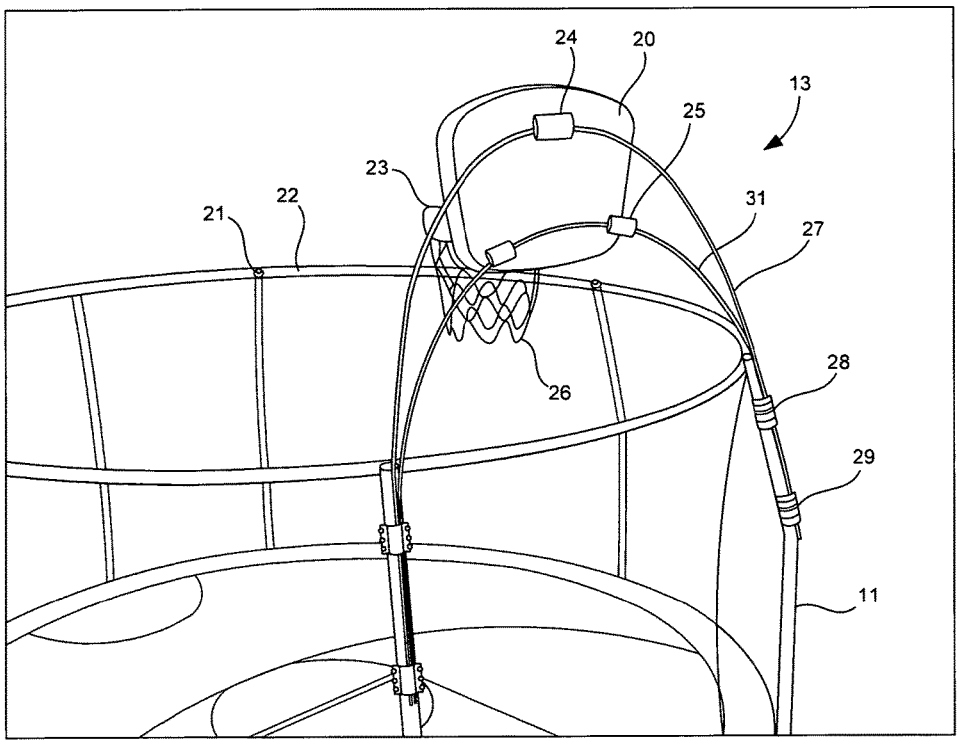
FIG. 2 is a rear view of the present invention showing that connection areas.
Figure 3:
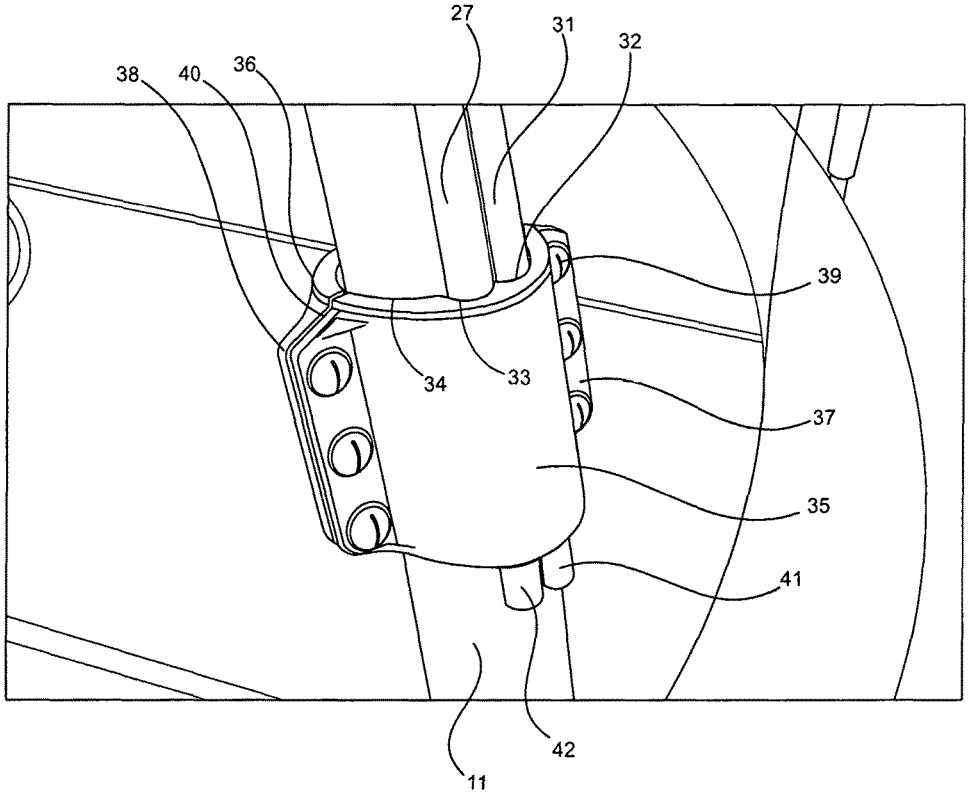
FIG. 3 is a close-up of the triple channel connector.
Figure 4:
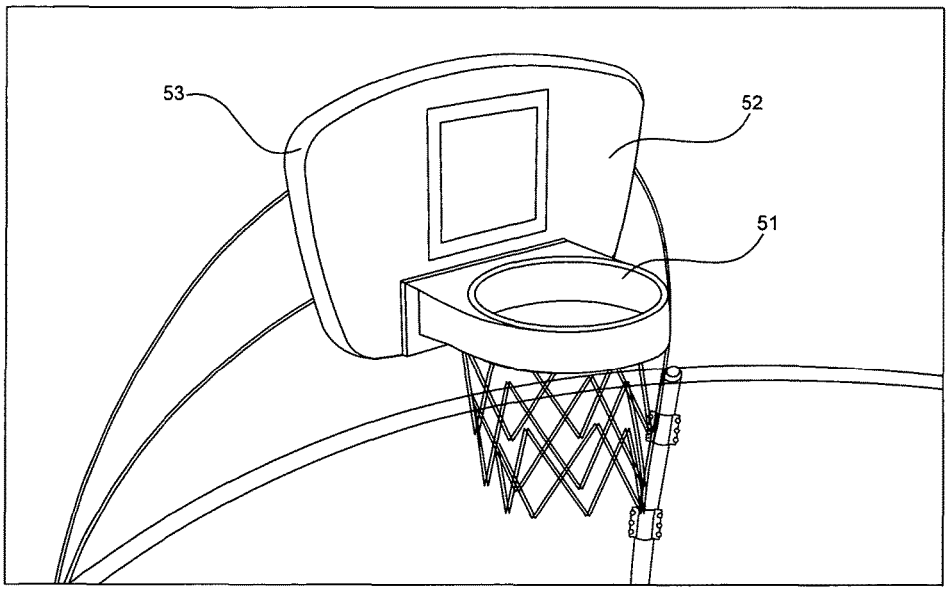
FIG. 4 is a close-up view of the basket from the perspective of a user jumping on the trampoline bed.

The following call out list of elements can be a useful guide in referencing the elements of the drawings.

11 Trampoline Enclosure Pole
12 Trampoline Spring Cover
13 Basketball Extension
14 Enclosure
15 Trampoline Frame
16 Trampoline Bed
20 Backboard
21 Enclosure Cap Connector
22 Enclosure Connector Upper Frame Member
23 Basketball Hoop
24 Upper Backboard Connector
25 Lower Backboard Connector
26 Basketball Net
28 Upper Arch Mount
27 Upper Arch Member
29 Lower Arch Mount
31 Lower Arch Member
32 Inside Channel
33 Outside Channel
34 Enclosure Pole Channel
35 Outside Mount Member
36 Inside Mount Member
37 Outside Mount Member Flange
38 Inside Mount Member Flange
39 Flange Bolts
40 Gap
41 Lower Arch Member Protrusion
42 Upper Arch Member Protrusion
51 Hoop Opening
52 Graphic Backboard
53 Backboard Edge

DETAILED DESCRIPTION OF THE PREFERRED EMBODIMENT

A trampoline having a trampoline frame 15 generally has a trampoline bed 16 that is connected to the trampoline frame 15 by a plurality of springs. The frame 15 is made of a tubular metal structure. The tubular metal members of the frame 15 can fit together in an interference fit, or using connectors such as screws or bolts. The springs are covered by trampoline spring covers 12 that can be padded or just a sheet. The trampoline bed 16 is enclosed by an enclosure 14 suspended from trampoline enclosure poles 11. The enclosure 14 can have a zipper entry and be made of a netting for retaining a user within the bounding area above the trampoline bed. The trampoline enclosure pole 11 can be a tubular metal member that is encapsulated in a foam sheath. The trampoline enclosure pole 11 can be mounted to the frame 15 at the frame legs using connectors. The trampoline enclosure pole 11 extends generally upwardly and supports the enclosure.

The enclosure cap connector 21 can be made as a plastic endcap that holds up the enclosure connector upper frame member 22. The enclosure cap connector 21 can have a slot for receiving the enclosure connector upper frame member 22. Extending above the enclosure connector upper frame number 22 is the basketball extension 13 that provides a basketball hoop 23, a basketball net 26 and a backboard 20. The basketball extension 13 is flexibly coupled to the frame 15 at the trampoline enclosure poles 11. The backboard 20 is preferably made of a soft material such as plastic foam encapsulated within a fabric cover. The backboard has three connectors mounted on the back that can be made as fabric sleeves for receiving the arch members.

The fabric sleeves can be curved or straight and sized so that they are long enough for retaining the backboard 20 at an apex of the arch members. The upper backboard connector 24 receives an upper arch member 27 through it. The lower backboard connector 25 receives a lower arch member 31 through it. The upper arch member 27 is fitted above the lower arch member 31. The pair of arch members form a pair of parabolic sections that converge at their legs where both the upper arch member and the lower arch member are clamped together at their lower ends. The arch members are preferably substantially flexible during play so that the backboard 20 moves if struck by a user.

The upper arch member and the lower arch member have lower ends that fit into arch mounts including an upper arch mount 28 and a lower arch mount 29. The upper arch member and the lower arch member can be made of metal, plastic, fiberglass, or the like. Tent poles can be used to provide sectioned portability. The upper arch member has a smaller radius of curvature than the lower arch member but both can be made from the same fiberglass pole material such that there is a biasing force between the upper arch member and the lower arch member to stabilize the basketball backboard. The upper arch member and the lower arch member can be made of the same material such as a metal rod, or a fiberglass rod encapsulated by plastic. If made in sections, the junction connection between sections is preferably behind the basketball backboard 20 away from contact by user.

The lower arch member fits into the inside channel 32, and the outside channel 33 receives the upper arch member 27. The enclosure pole channel 34 receives the enclosure pole 11. An outside mount member 35 connects to an inside mount member 36. The inside mount member has an inside mount member flange and the outside mount member has an outside mount member flange. The inside mount member flange 38 connects to the outside mount member flange 37 by three connectors such as flange bolts 39. A gap 40 is formed between the inside mount member flange and the outside mount member flange. The lower arch member protrudes from the inside channel 32 at a lower arch member protrusion 41. The upper arch member protrudes from the outside channel 33 at an upper arch member protrusion 42. Each of the arch members protrude downwardly away from the outside mount member.

Once mounted on the trampoline, the basketball hoop preferably has a soft molded hoop opening 51 to prevent fingers or loose articles from becoming caught to the hoop. The backboard preferably has a graphic printed image 52 that can be thermally laminated to the backboard. The backboard edge 53 preferably has a rounded soft edge such as a cushion for attenuating impact or shock.

A key safety feature of the present invention resides in the flexibility of the pair of arch members. The pair of arch members are resiliently flexible so that a limb caught in the hoop opening 51 have lessened likelihood of injury. Also, if a user jumps into the backboard, the upper connector and the lower connector are preferably soft and can be loosely clipped or attached to provide a detachable configuration. In the event of user collision or intentional misuse such as by grabbing onto the basketball hoop, the pair of arch members resiliently flexes inward to a predetermined angle before the backboard detaches from the pair of arch members. For example, the pair of arch members can be connected to the backboard 20 by hook and loop tape sleeves to allow release at a predetermined angle for force corresponding to a predetermined angle.

Preferably, the pair of arch members can be held within a sleeve or cover to provide safety so that the user does not have finger or hand pinching between the gap formed by the pair of arch members. The arch member cover is preferably of a thick weather resistant fabric to provide a solid panel which can also retain the foam basketball within the playing area.

The invention claimed is:

1. A basketball trampoline device comprising:

a. a trampoline having a trampoline bed, an enclosure, and enclosure poles supporting the enclosure;

h. an upper arch member, wherein the upper arch member is attached to a first enclosure pole;

c. a lower arch member, when the lower arch member is attached to a second enclosure pole, wherein the upper arch member and the lower arch member form an arch member pair, wherein the lower upper arch member is mounted below the upper arch member;

d. a basketball backboard and hoop mounted to the upper arch member and the lower arch member by at least three backboard connectors including an upper backboard connector that connects to the upper arch member and a lower backboard connector that connects to the lower arch member, wherein the upper arch member is fitted above the lower arch member to form the arch member pair defining a crescent-shaped flexible extension frame, wherein the upper arch member and the lower arch member are flexible and attached to the first enclosure pole and to the second enclosure pole, wherein the enclosure poles are not as flexible as the arch members.

2. The basketball trampoline device of claim 1, wherein the arch member pair forms a pair of parabolic shaped sections that converge at their lower ends where both the upper arch member and the lower arch member are clamped together at their lower ends.

3. The basketball trampoline device of claim 1, further including fabric sleeves formed on the backboard for retaining the backboard to the arch members, wherein the fabric sleeves form an upper backboard connector which receives the upper arch member, and wherein the lower backboard connector receives the lower arch member.

4. The basketball trampoline device of claim 1, wherein the arch member pair form a pair of parabolic sections that convene at their legs where both the upper arch member and the lower arch member are clamped together at their lower ends.

5. The basketball trampoline device of claim 1, wherein the upper arch member and the lower arch member have lower ends that fit into arch mounts including an upper arch mount and a lower arch mount, wherein the upper arch member has a smaller radius of curvature than the lower arch member.

6. The basketball trampoline device of claim 1, wherein the upper arch member and the lower arch member are made of the same material, namely flexible metal rods or flexible fiberglass rods.

7. The basketball trampoline device of claim 1, wherein a first mount member connects the arch member pair to the first enclosure pole, wherein the first mount member retains the lower arch member in an inside channel formed on the first mount member, and wherein the first mount member retains the upper arch member in an outside channel formed on the first mount member, wherein the first mount member further includes an enclosure pole channel that receives the first enclosure pole.

8. The basketball trampoline device of claim 7, wherein the arch member pair forms a pair of parabolic shaped sections that converge at their lower ends where both the upper arch member and the lower arch member are clamped together at their lower ends.

9. The basketball trampoline device of claim 7, further including fabric sleeves formed on the backboard for retaining the backboard to the arch members, wherein the fabric sleeves form an upper backboard connector which receives the upper arch member, and wherein the lower backboard connector receives the lower arch member.

10. The basketball trampoline device of claim 7, wherein the arch member pair form a pair of parabolic sections that converge at their legs where both the upper arch member and the lower arch member are clamped together at their lower ends.

11. The basketball trampoline device of claim 7, wherein the upper arch member and the lower arch member have lower ends that fit into arch mounts including an upper arch mount and a lower arch mount, wherein the upper arch member has a smaller radius of curvature than the lower arch member.

12. The basketball trampoline device of claim 7, wherein the upper arch member and the lower arch member are made of the same material, namely flexible metal rods or flexible fiberglass rods.

13. The basketball trampoline device of claim 7, wherein the first mount member is formed as an outside mourn member that connects to an inside mount member, wherein the inside mount member has an inside mount member flange and the outside mount member has an outside mount member flange, wherein the inside mount member flange connects to the outside mount member flange.

14. The basketball trampoline device of claim 13, wherein the arch member pair forms a pair of parabolic shaped sections that converge at their lower ends where both the upper arch member and the lower arch member are clamped together at their lower ends.

15. The basketball trampoline device of claim 13, further including fabric sleeves formed on the backboard for retaining the backboard to the arch members, wherein the fabric sleeves form an upper backboard connector which receives the upper arch member, and wherein the lower backboard connector receives the lower arch member.

16. The basketball trampoline device of claim 13, wherein the arch member pair form a pair of parabolic sections that converge at their legs where both the upper arch member and the lower arch member are clamped together at their lower ends.

17. The basketball trampoline device of claim 13, wherein the upper arch member and the lower arch member have lower ends that fit into arch mounts including an upper arch mount and a lower arch mount, wherein the upper arch member has a smaller radius of curvature than the lower arch member.

* * * * *